United States Patent [19]

Lubbe

[11] 4,074,094

[45] Feb. 14, 1978

[54] ELECTRIC SWITCH STRUCTURE INCORPORATING TRIP ROD FOR SENSING CABLE DERAILMENT AND THE LIKE

[76] Inventor: Bruno Lubbe, 3695 Warren Way, Reno, Nev. 89502

[21] Appl. No.: 656,806

[22] Filed: Feb. 10, 1976

[51] Int. Cl.[2] ..... H01H 3/16; B61B 12/06

[52] U.S. Cl. ..... 200/61.13; 200/61.18; 200/61.41; 200/163

[58] Field of Search ..... 200/52 R, 51.13, 61.08, 200/61.13, 61.18, 61.41, 61.42, 61.44, 61.85, 61.8, 76, 85 R, 153 H, 153 K, 163, 252, 258, 302, 16 B, 16 E, 16 F; 104/173 R, 173 ST, 178

[56] References Cited

U.S. PATENT DOCUMENTS

| | | | |
|---|---|---|---|
| 602,767 | 4/1898 | McPherson | 200/76 |
| 1,873,797 | 8/1932 | Turner | 200/16 E |
| 2,441,888 | 5/1948 | Lansing | 200/16 B |
| 2,717,941 | 9/1955 | Steiner | 200/302 |
| 3,346,710 | 10/1967 | Weston et al. | 200/163 X |
| 3,471,660 | 10/1969 | Peters | 200/61.13 |
| 3,822,369 | 7/1974 | Kunczynski | 200/61.08 |
| 3,842,221 | 10/1974 | Dayet et al. | 200/52 R |

*Primary Examiner*—James R. Scott
*Attorney, Agent, or Firm*—Spensley, Horn & Lubitz

[57] ABSTRACT

This electric switch structure provides within a rugged, hermetically sealed housing a set of insulated, moveable discs that may reciprocate relative to one another, the discs being interconnected and positioned by a set of parallel guide rods. One disc is held in a fixed position relative to the housing; the remaining portion of the disc set is movable from a position in which contacts on the adjacent faces of the discs are engaged to a position in which these contacts are disengaged. This movement is controlled by an external trip rod positioned to bear on the exterior of the housing, the trip rod being attached to the disc set by an interconnecting member and moveable between two stable positions, a first or extended position and a second or actuated position. Preferably the disc set includes at least three discs movable from a position in which two discs engage to a second position and which another two discs engage, the first position controlling one circuit, the second position controlling another circuit.

8 Claims, 4 Drawing Figures

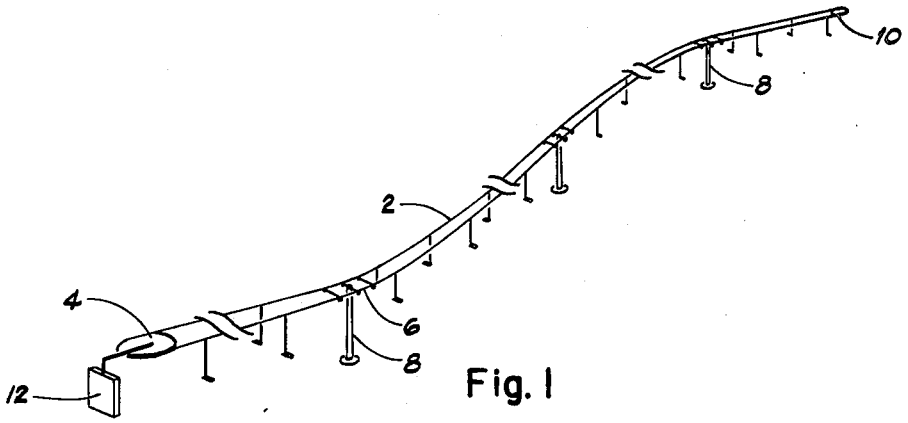
Fig. 1
Fig.2
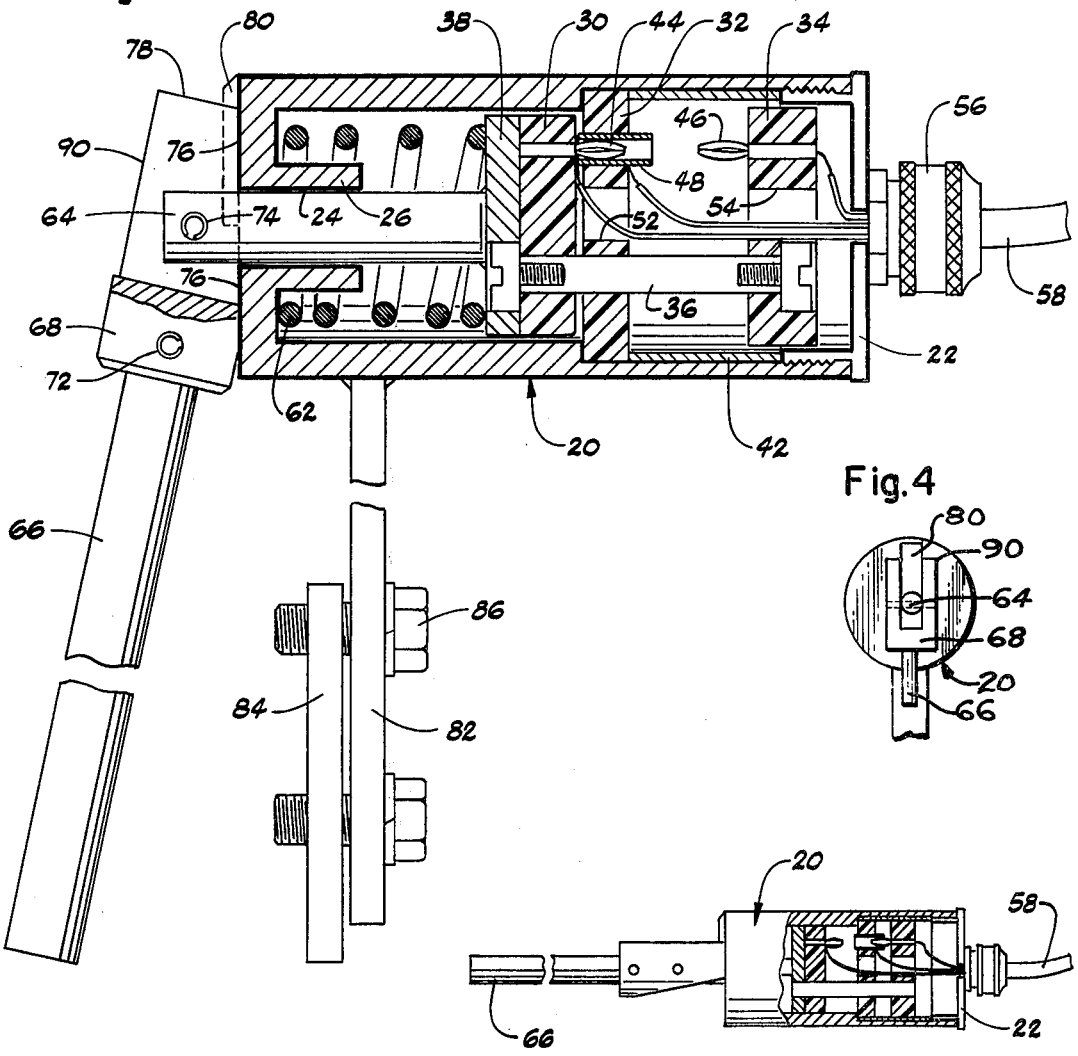
Fig.4
Fig.3

ELECTRIC SWITCH STRUCTURE INCORPORATING TRIP ROD FOR SENSING CABLE DERAILMENT AND THE LIKE

BACKGROUND OF THE INVENTION

Electrical systems, and electrically powered mechanisms, often require switches that are exposed to severe weather conditions. In such an environment, snow, ice and the like can, with time, completely encrust the switch. If the switch is not designed to properly operate when so encrusted, its function and usefullness will be impaired or destoryed. Few switches have met the test of such severe conditions. No simple, economical, readily servicable switch has proven satisfactory.

As an example of such a switch and system, ski lifts require by law some form of controller adjacent to each tower over which the lift enable cable passes, and at various positions about the upper and lower ends of the ski lift run. These controllers must be positioned to sense any movement of the ski lift cable beyond a predetermined point, such as would occur if the cable becomes derailed, and other conditions adjacent the ends of the ski lift, any one of which will cause the controller to stop operation of the lift immediately. Should this occur, it is required that the controller manually be reset by the ski lift operator, the manual resetting operation giving the operator an opportunity to inspect the problem area to determine and correct the cause of the malfunction.

As an example, one type of controller that has been employed in ski lift systems is a simple printed circuit board positioned to be physically broken by a malfunction. Of course, this physical destruction of the controller by a malfunction is expensive. The operator must replace the broken circuit board and make good electrical contact to reconnect and complete this controller system. When it is cold, snowing, or very windy, it is quite difficult to do this high on a ski lift tower. The tendency of the operator, instead of facing such a chore, is to simply bypass the switch with a short rendering the controller ineffective but at least re-establishing the operation of the ski lift.

BRIEF DESCRIPTION OF THE INVENTION

The disclosed electric switch structure provides within a rugged, hermetically sealed housing a set of insulated, moveable discs that may reciprocate relative to one another, the discs preferably being interconnected and positioned by a set of parallel guide rods. One portion of the disc set is held in a fixed position relative to the housing; the remaining portion of the disc set is moveable from a position in which contacts on the adjacent faces of the discs are engaged to a position in which these contacts are disengaged. This movement is controlled by an external trip rod positioned to bear on the exterior of the housing, the trip rod being attached to the disc set by an interconnecting member and moveable between two stable positions, a first or extended position and a second or actuated position. The interconnecting member and disc set is biased by a spring within the housing, preferably to a position in which the interconnecting member is retracted into the housing. In this position, the trip rod includes a face that bears upon the exterior of the housing to position the trip rod in the second, or actuated, position. The trip rod may be moved to the first position, preferably a position in which it extends axially away from the housing, the trip rod in being moved to this position compressing the spring means. Upon reaching this position, preferably the trip rod includes a face that bears against the housing to hold the trip rod in this first, or extended, position. Preferably the disc set includes at least three discs movable from a position in which two discs engage to a second position and which another two discs engage, the first position controlling one circuit, the second position controlling another circuit. Such a structure may be included in a ski lift system, serving as a controller to both break the electrical power circuit driving the lift and to establish a circuit indicating the location of the malfunction.

This preferred switch structure provides in a rugged, weather tight housing a simple, economical structure that has been shown by tests in a ski lift system to establish good electrical contact even in the most severe of weather conditions. Because of the particular manner in which the switch is constructed and the trip rod interconnected with the actuating mechanism of the switch, tests have shown that the entire switch assembly may be completely and solidly encased in a thick block of ice and still properly operate, breaking away the ice in some areas during movement of the trip rod from its extended position to its actuated position.

BRIEF DESCRIPTION OF THE DRAWINGS

The invention will be further described in connection with the accompanying drawings in which:

FIG. 1 is a partial view of a ski lift system;

FIG. 2 is a view partially in cross-section of the preferred switch structure, the trip rod being shown is an actuated position;

FIG. 3 is a view similar to FIG. 2 showing the trip rod in an extended position; and FIG. 4 is an end view, partially in section, of the preferred switch structure.

DETAILED DESCRIPTION OF THE INVENTION

The disclosed electric switch structure may be employed to control or actuate an electrical system upon its trip rod being moved from an extended to an actuated position by an external event. This electric switch is particularly useful in locations in which severe weather conditions are likely to be encountered. One example of such an application, and a preferred application of the invention, is in ski lift systems. Some of the major elements of such a lift are illustrated in FIG. 1. The lift includes a cable loop 2, which passes over a bull wheel 4 at the lower end of the lift system as well as over sheavesets 6 supported by towers 8 and about a bull wheel 10 at the upper end of the system. Should a portion of the cable become disengaged from one of the sheavesets, this conditions must be sensed immediately and the system shut down until the malfunction is corrected.

The electric switch disclosed herein is particularly useful in such an environment. Such a switch may be positioned on each of the sheavesets in a location in which the cable upon disengaging from a sheave causes the switch to be actuated. Other desirable locations for such switches include the area at the top portion of the ski lift beyond the disembarking platform, the switch being positioned to sense the presence of a skier still on the lift after the disembarking platform and to be actuated by this condition to shut down the system. Another preferred location of the switch is adjacent the weight 12 biasing the lower bull wheel to determine the tension on the system, the weight rising and falling as the load on the system varies. Switches may be positioned to determine the upper and lower limit of movement of this weight and to shut down the system should these limits be exceeded. Since control switches may be positioned at many locations throughout a ski lift, it is preferred to incorporate into the switch a second circuit that will immediately indicate to the operator of the lift the location of the malfunction, permitting the malfunction to be found and corrected in a minimum amount of time.

It should be understood, therefore, however, that while the electric switch structure disclosed herein is particularly useful in applications exposing it to severe weather conditions, such as in a ski lift system, it is also useful in many other applications.

The preferred structure of the switch is shown in FIG. 2. The switch includes a cylindrical housing 20 threaded to receive a cap 22. The housing incorporates in its base a central cylindrical opening 24 and an inwardly extending collar portion 26.

The switch mechanism itself consists of a set of three discs, discs 30, 32 and 34, the discs preferably formed of an insulating material such as a Lucite. The discs are positioned to face one another as shown, and are interconnected and guided in their movement relative to one another by a set of parallel guide rods 36. At one end, these guide rods are affixed to disc 34 by any convenient means such as the illustrated threaded screw connection. The rods pass through openings in disc 32 and, in the preferred embodiment, also passs through openings in disc 30 to be affixed to the face of an actuating piston 38 in any convenient manner, such as by the illustrated threaded screw connection. Disc 30 is attached to the face of this actuating piston in any convenient manner such as by the illustrated threaded screw connection.

The set of three discs are received in the housing as shown. The center disc 32 is slightly larger in diameter than the outer two discs. The inner end portion of housing 20 is enlarged somewhat to receive and provide a seat for the outer periphery of this enlarged disc 32. A bushing 42 is received within the end portion of the housing to encircle disc 34, one end of the bushing bearing on the outer periphery of disc 32, the other end bearing upon the inner base of cap 22. Thus, disc 32 is firmly held in position between bushing 42 and the seat in housing 20. As the actuating piston 38 reciprocates within the housing, discs 30 and 34 move relative to disc 32. Contacts are provided on these discs so that disc 32 will make electrical contact with the adjacent disc, which may be either disc 30 or disc 34. Preferably these contacts include a banana plug 44 on disc 30, a banana plug 46 on disc 44 and a sleeve 48 passing through disc 32. These banana plugs and the sleeve are axially aligned, the banana plugs reciprocating with discs 30 and 34 to make alternate electrical contact with sleeve 48 in disc 42. Wires are connected to the banana plugs and to sleeve 48, the wire connected to banana plug 44 passing through a central opening 52 in disc 32 and, together with the wire connected to sleeve 48, also passing through a central opening 54 in sleeve 34. All three wires merge into an electrical cable with an outer sheath. This cable passes through a central opening in cap 22 and through a connector 56 incorporating compression bushings to provide a weather-tight seal to the electrical cable.

A powerful compression spring 62 is received about collar 26 and bears upon the opposed faces of the actuating piston 38 and the base of housing 20, its compression forcing the actuating piston to move disc 30 into an engagement with disc 32. The rod 64 of the actuating piston passes through opening 24 in the housing. O-ring seals (not shown) may be provided in collar 26 to seal to the rod of the actuating piston. However, it has been found that reasonable tolerances between the rod and collar will maintain the interior of the switch reasonably weather-tight. The trip rod includes a projection rod portion that is connected at its base to a yoke 68, as by a companion spring pin 72, the yoke being generally U-shaped. This yoke receives between its legs the projecting portion of rod 64, and is connected to the yoke by a compression spring pin 74 passing through aligned openings. It is preferred that this opening be offset somewhat and positioned in the yoke and the dimensions of the actuating piston rod adjusted to permit the trip rod to move only between the extended and actuated positions shown in FIGS. 2 and 3. In other words, because of these dimensions and the lateral offset of the openings receiving pin 74, the trip rod cannot rotate up from the position shown in FIG. 3 to any significant degree. The corner between face 78 and edges 80 also assists significantly in preventing this movement.

The trip rod 66, when actuated, is positioned generally as shown in FIG. 2, yoke 68 including a face 76 that abuts the base of housing 20. The trip rod may be manually rotated outwardly from this position to a position in which the rod extends generally along the axis of the cylindrical housing, as shown in FIG. 3. In being moved, rod 64 is pulled outwardly, causing the actuating piston 38 to compress spring 62. Upon reaching its extended position the trip rod yoke includes a face 78 that bears against the surface about opening 24 in the housing, this seating stabilizing the trip rod in the extended position shown in FIG. 3 and against the compressive force of spring 62. A ridge 80 is provided on the base of the housing to hold legs of the yoke 68 and thereby the trip rod in a predetermined plane and to prevent the trip rod from rotating the internal elements of the switch as it moves between its positions. Thus, the ridge mates with and guides the trip rod yoke as it moves between its two positions.

The housing may be attached to a supporting structure by any convenient means. For example, a bar 82 may be welded to the housing and incorporate a plate 84 attached to bar 82 by bolts 86, the bolts upon being tightened clamping a portion of a supporting structure between bar 82 and plate 84. By this or any other convenient means, the housing is positioned in an appropriate location to cause the trip rod to be moved from its extended to its actuated position upon occurrence of physical event such as those previously described in connection with a ski lift system. When this occurs, it causes trip rod 66 to rotate partially about pin 74, disengaging face 78 from the base of the housing. As the corner of the yoke between faces 76 and 78 slips past the axis of the piston rod 64, the force exerted by compression spring 62 on the actuating position begins to urge the trip rod to move to its actuated position. After a slight bit of additional rotation, actuation then will be due mainly to the spring, causing the trip rod to move crisply into the actuated position with a distinct "snap". This positive actuation of the switch is an important feature of the structure, preventing the switch from being hung up in an intermediate position in which neither or both of the electrical circuits are completed.

Preferably, the exterior surface of the yoke 68 is cylindrical, the slot in the yoke which defines the two legs of the yoke thereby providing a sharp edge along both exterior edges 90 of the yoke. Thus, should the switch structure be completely encased in ice or snow, as the rod begins to rotate from its extended to its actuated position this knife edge will assist in fracturing and chipping away the casing material. Also, the points provided where edges 90 intersect surfaces 78 further assist in achieving this shattering action to free the trip rod. In addition, trip rod 66 preferably is of substantial diameter and length so that the actuating condition can exert appreciable leverage on the rod to ensure that the rod will move to its actuated condition in spite of the extent to which the switch structure has become encased by ice or snow.

The switch structure may be easily reset manually simply by moving trip rod 66 from its actuated position back out to its extended position. It is preferred that the rod be a smooth surface to prevent to a significant degree the trip rod from being reset from a distance but requiring the operator to manually reset it. This provides the operator with an opportunity to inspect for problems the structure which caused the switch to be actuated.

While the switch may include only a pair of discs to provide one circuit which is either completed or broken when the trip rod is actuated, it is preferred that three discs be incorporated, as shown, to cause one circuit to be broken and another to be completed upon actuation of the trip rod. The circuit completed between banana plug 44 and sleeve 48 when the trip rod is in an extended position, as shown in FIG. 3, preferably is employed to complete the power circuit to the electric motor driving the ski lift whle the circuit completed between banana plug 46 and sleeve 48 when the trip rod is in an actuated position, as shown in FIG. 2, preferably is part of an indicator circuit that visibly identifies to the operator the location of the tripped switch and the malfunction of the system.

The switch is designed to be assembled and dismantled quickly and easily. All that is required to assemble the switch is to simply drop the various elements into the housing in their proper order, the disc set previously having been assembled and attached to the actuating piston. Next, the disc set is compressed against spring 62 sufficiently to project rod 64 beyond the base of the housing enough to permit trip rod to be attached to it. Then the wires may be attached to the discs of the disc set, if this has not already been done, and cap 22 screwed down tightly to complete the assembly. Dismantling the switch is just as simple, being basically the reverse of the operation just described.

Various modifications may be made to the preferred structure and, of course, many such modifications will occur to those skilled in this art. Accordingly, the scope of the invention is set forth in the following claims.

I claim:

1. An electric switch structure including a housing, a disc set, means supporting the disc set within the housing, the disc set including electrical contacts, the disc set being moveable from a first position in which the electric contacts on two of the discs within the set are engaged to a second position in which said contacts are disengaged, a trip rod, means connecting the trip rod to the disc set to move the disc set from the first to the second position upon movement of the trip rod from a first to a second position, the connecting means including a shaft having a portion extending through an opening in the housing, a yolk connected to the trip rod, the yolk being positioned about and pivotally connected to the portion of the shaft external to the housing, the yolk of the trip rod including two faces which may be caused selectively to bear against the exterior surface of the housing, one face positioning the trip rod in a first, extended position, the other face positioning the trip rod in a second, deflected position.

2. An electric switch as set forth in claim 1, including spring means within the housing to urge the disc set into one of said two positions, the housing being cylindrical, the connecting means including an actuating piston, at least one of the discs in a disc set being connected to the actuating piston, and in which the faces of the yolk cooperate with an abutting surface of the housing to hold the trip rod in either the extended or the deflected position, the spring means urging the actuating piston to a position in which the trip rod is in a deflected position.

3. An electric switch structure as set forth in claim 2 in which the disc set includes three discs, two of the discs being movable relative to the third disc, and contacts on the three discs to complete either of two circuits, one circuit when the discs are in the first position, the other circuit when the discs are in the second position.

4. An electric switch structure as set forth in claim 3 in which the discs are positioned to lie generally in parallel planes, parallel guide rods interconnecting the outer two discs of the set and passing through openings in the center disc to cause the outer two discs to move in unison relative to the center disc, means fixing the center disc relative to the housing, the actuating piston being connected to the outer discs of the set and causing them to move relative to the housing and the center disc to selectively connect the contact on the center disc to the contact one one of the outer discs.

5. An electric switch as set forth in claim 4 in which the two faces of yoke join in a line substantially intersecting the axis of the trip rod to permit the trip rod to be moved easily between its two stable positions.

6. An electric switch structure as set forth in claim 5 in which the yoke of the trip rod includes sharp edges to break away elements encrusting the housing as the trip rod moves from an extended to a deflected position.

7. An electric switch structure as set forth in claim 6, the housing including an exterior guide that intermeshes with the yoke of the trip rod and guides the trip rod as it moves between its two predetermined positions.

8. An electric switch structure as set forth in claim 1 in which the yoke surfaces defining said faces includes sharp edges to break away encrusting elements about the housing as the trip rod moves from an extended to deflected position.

* * * * *